US010494866B2

(12) United States Patent
Hsu

(10) Patent No.: US 10,494,866 B2
(45) Date of Patent: Dec. 3, 2019

(54) SWIMMING POOL LADDER WITH AUTOMATIC LIFT MECHANISM

(71) Applicant: Intex Marketing Ltd., Tortola (VG)

(72) Inventor: Yaw Yuan Hsu, Fujian (CN)

(73) Assignee: Intex Marketing Ltd., Tortola (VG)

( * ) Notice: Subject to any disclaimer, the term of this patent is extended or adjusted under 35 U.S.C. 154(b) by 75 days.

(21) Appl. No.: 15/804,276

(22) Filed: Nov. 6, 2017

(65) Prior Publication Data

US 2018/0127997 A1 May 10, 2018

(30) Foreign Application Priority Data

Nov. 7, 2016 (CN) ..... 2016 2 1198305 U

(51) Int. Cl.

| | |
|---|---|
| ***E06C 1/24*** | (2006.01) |
| ***E06C 7/00*** | (2006.01) |
| ***E04H 4/06*** | (2006.01) |
| ***E04H 4/14*** | (2006.01) |
| ***E06C 1/28*** | (2006.01) |
| ***E06C 7/12*** | (2006.01) |

(52) U.S. Cl.

CPC ..... *E06C 7/006* (2013.01); *E04H 4/06* (2013.01); *E04H 4/144* (2013.01); *E06C 1/28* (2013.01); *E06C 7/12* (2013.01)

(58) Field of Classification Search

CPC ..... E06C 1/14; E06C 1/22; E06C 1/28; E06C 1/42; E06C 1/46; E06C 5/04; E06C 5/16; E06C 5/18; E06C 5/00; E06C 7/42; E06C 7/47; E04H 4/06; E04H 4/144

See application file for complete search history.

(56) References Cited

U.S. PATENT DOCUMENTS

| | | | | |
|---|---|---|---|---|
| 2,975,857 A * | 3/1961 | Suroff | ..... | E06C 7/44 182/166 |
| 3,106,986 A | 10/1963 | Ray | | |
| 3,225,863 A | 12/1965 | Ludlow | | |
| 3,288,248 A | 11/1966 | Gurian et al. | | |

(Continued)

FOREIGN PATENT DOCUMENTS

| | | |
|---|---|---|
| CN | 201190435 | 2/2009 |
| CN | 206279812 | 6/2017 |
| DE | 202 08 897 | 11/2002 |

OTHER PUBLICATIONS

Photograph of ladder from Kayak Pool Corporation, Photo Gallery, 1 page, available at http://www.kayakpools.com/corporate/KP_Hamburg_2.JPG, accessed on Nov. 5, 2010.

(Continued)

*Primary Examiner* — Colleen M Chavchavadze

(74) *Attorney, Agent, or Firm* — Faegre Baker Daniels LLP

(57) ABSTRACT

The present disclosure provides a ladder which selectively allows or prevents user access to the ladder steps, such that the ladder can only be climbed when such access is allowed. For example, the ladder may only selectively allow ingress into a bathing enclosure, e.g. when operated by an adult, but may allow egress from the bathing enclosure by any user. The ladder includes an elevator that is movable between a safety configuration, in which ingress is prevented or inhibited but egress is permitted, and a ladder configuration, in which both ingress and egress are permitted.

15 Claims, 14 Drawing Sheets

(56) References Cited

U.S. PATENT DOCUMENTS 3,311,195 A 3/1967 Singer
3,372,772 A 3/1968 Singer
3,428,146 A 2/1969 Bair
3,447,633 A 6/1969 Montalto
3,586,124 A 6/1971 Kunzweller et al.
3,964,572 A 6/1976 Gannon
3,991,851 A 11/1976 Gannon
4,182,431 A * 1/1980 Wing ..... E06C 1/12 182/167
4,579,197 A 4/1986 Spurling
4,805,736 A 2/1989 Byrnes, Jr.
4,811,767 A 3/1989 Kessler
5,111,906 A * 5/1992 Abadia ..... E06C 9/06 182/163
5,343,977 A 9/1994 Bryan
5,362,116 A 11/1994 Doyle et al.
5,441,126 A 8/1995 Orrick
5,664,769 A 9/1997 Sadinsky et al.
5,682,960 A 11/1997 Mobley et al.
6,053,284 A * 4/2000 Fountain ..... E06C 7/42 182/180.2
6,666,435 B2 12/2003 Blosfelds
6,698,550 B2 * 3/2004 Crain ..... E06C 1/22 182/166
6,755,281 B2 6/2004 Saputo et al.
6,880,674 B1 4/2005 St-Hilaire
7,044,511 B2 5/2006 Kliefoth et al.
D525,369 S 7/2006 Houze
7,100,405 B2 9/2006 West
7,137,479 B2 * 11/2006 Ziaylek ..... B60R 9/0423 182/127
7,390,035 B2 6/2008 Karcz et al.
7,717,231 B2 5/2010 Horton
7,753,169 B1 * 7/2010 Kurtz ..... E06C 1/39 182/129
8,191,681 B2 6/2012 Lipniarski
8,191,682 B2 6/2012 Lipniarski
8,202,018 B2 6/2012 Lipniarski
8,347,555 B2 1/2013 Chen
8,376,421 B2 2/2013 Simmonds
8,505,989 B2 8/2013 Wells
D700,715 S 3/2014 Kubik
8,720,644 B2 5/2014 Naranjo et al.
9,033,377 B2 5/2015 Day et al.
9,074,384 B2 7/2015 Lin et al.
9,193,305 B2 * 11/2015 Kramer ..... B60R 9/042
9,422,769 B2 * 8/2016 Troise ..... B64C 1/24
2005/0121261 A1 * 6/2005 Moss ..... E06C 1/22 182/165
2005/0210938 A1 9/2005 Doyle et al.
2005/0269159 A1 * 12/2005 Lin ..... E06C 1/18 182/209
2007/0193833 A1 8/2007 Nickelson
2007/0194578 A1 8/2007 Boosey et al.
2011/0072574 A1 3/2011 Hsiang Lin
2011/0148126 A1 6/2011 Macernis
2012/0145480 A1 * 6/2012 Willis ..... E06C 5/06 182/106
2012/0228058 A1 9/2012 Dubois
2012/0312635 A1 12/2012 Randolph
2013/0117923 A1 * 5/2013 Toner ..... E04H 4/144 4/504
2014/0225383 A1 8/2014 Simmonds et al.
2015/0015002 A1 1/2015 Macernis
2015/0337575 A1 11/2015 Macernis
2016/0160562 A1 * 6/2016 Cheng ..... E06C 7/006 4/504
2017/0152708 A1 * 6/2017 Lin ..... E06C 7/006
2017/0254145 A1 * 9/2017 Ballard ..... E06C 1/22
2017/0260809 A1 * 9/2017 Leng ..... E06C 1/18
2017/0356244 A1 * 12/2017 Peterson ..... E06C 1/22

OTHER PUBLICATIONS

Confer Plastics, Inc., The Leader in Ladders Brochure, 6 pages, published Jan. 2013, available at http://www.conferplastics.com/ConferBrochureLadder.pdf.

International Search Report dated Oct. 15, 2012 in PCT/US2012/048486, 10 pages.

* cited by examiner

SWIMMING POOL LADDER WITH AUTOMATIC LIFT MECHANISM

CROSS REFERENCE TO RELATED APPLICATIONS

This application claims priority to the following Chinese patent application, the disclosure of which is hereby expressly incorporated by reference herein in its entirety:

| Application No. | Filing Date |
|---|---|
| CN 201621198305.9 | Nov. 7, 2016 |

FIELD OF THE DISCLOSURE

The present disclosure relates to ladders. More particularly, the present disclosure relates to ladders for use with above-ground pools or spas, and to methods for using the same.

BACKGROUND OF THE DISCLOSURE

An above-ground bathing enclosure, such as a pool or spa, may require a ladder to facilitate ingress into, and egress from, the bathing enclosure. In some cases, it may be desirable to restrict ingress into the bathing enclosure except by certain users, such as adults.

SUMMARY

The present disclosure provides a ladder which selectively allows or prevents user access to the ladder steps, such that the ladder can only be climbed when such access is allowed. For example, the ladder may only selectively allow ingress into a bathing enclosure, e.g., when operated by an adult, but may allow egress from the bathing enclosure by any user. The ladder includes an elevator that is movable between a safety configuration, in which ingress is prevented or inhibited but egress is permitted, and a ladder configuration, in which both ingress and egress are permitted.

In one form thereof, the present disclosure provides a ladder assembly including a fixed portion, a moveable ladder support, a moveable ladder and a lock device. The fixed portion includes a first left upright, a first right upright cooperating with the first left upright to define a first lateral gap, and at least one fixed ladder step spanning the first lateral gap. The moveable ladder support includes a second left upright and a second right upright respectively cooperating with the first left upright and the first right upright to form a space sized to receive a wall of a bathing enclosure between the moveable ladder support and the fixed portion. The moveable ladder is slidably coupled to at least one of the second left upright and the second right upright, and includes a left support rod and a right support rod defining a second lateral gap and at least one moveable ladder step spanning the second lateral gap. The moveable ladder is moveable along at least one of the second left upright and the second right upright between a safety configuration, in which the at least one moveable ladder step is positioned in at a first elevation, and a ladder configuration, in which the at least one moveable ladder step is positioned in at a second elevation lower than the first elevation. The lock device includes a buckle and a biasing element urging the buckle into a locking configuration in which the buckle engages the moveable ladder in the safety configuration, the buckle moveable against the urging of the biasing element into a disengaged configuration in which the buckle disengages from the moveable ladder such that the moveable ladder is free to move from the safety configuration to the ladder configuration.

In another form thereof, the present disclosure provides a ladder assembly including affixed portion, a moveable ladder support, a moveable ladder, a reset device and a traction device. The fixed portion includes a first left upright, a first right upright cooperating with the first left upright to define a first lateral gap, and at least one fixed ladder step spanning the first lateral gap. The moveable ladder support includes a second left upright and a second right upright respectively cooperating with the first left upright and the first right upright to form a space sized to receive a wall of a bathing enclosure between the moveable ladder support and the fixed portion. The moveable ladder is slidably coupled to at least one of the second left upright and the second right upright, and includes a left support rod and a right support rod defining a second lateral gap and at least one moveable ladder step spanning the second lateral gap. The moveable ladder is moveable along at least one of the second left upright and the second right upright between a safety configuration, in which the at least one moveable ladder step is positioned in at a first elevation, and a ladder configuration, in which the at least one moveable ladder step is positioned in at a second elevation lower than the first elevation. The reset device is coupled to at least one of fixed portion and the moveable ladder support, and is configured to move the moveable ladder from the ladder configuration to the safety configuration. The reset device further includes a spring, a damper coupled with the spring such that the damper acts to limit a rate of spring activation to thereby automatically delay return of the moveable ladder from the ladder configuration to the safety configuration, and a rotary retractor acted upon by the spring and the damper, the rotary retractor functionally coupled to the moveable ladder and configured to move the moveable ladder between the ladder configuration and the safety configuration. The traction device is operably coupled to the rotary retractor of the reset device and fixed to at least one of the second left upright and the second right upright of the moveable ladder support, such that the traction device transfers the force of the spring to the moveable ladder.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

The present disclosure relates to ladders, such as ladders 100, 100A, and 100B respectively shown in FIGS. 1, 10 and 11 and described in detail below, which are configurable to selectively allow or prevent access to steps of the ladder. Ladders 100, 100A, 100B may be reconfigurable only by qualified users, e.g., adults, in order to prevent unsupervised use by children. Specifically, the present disclosure provides ladders 100, 100A, 100B having a restriction mechanism configurable in a safety configuration, in which the step surfaces are elevated above the point where a user's foot can gain purchase, especially if the user is a child. Thus, a user is unable to climb the ladder when the restriction mechanism is in the safety configuration. Ladders 100, 100A, 100B also have a ladder configuration, in which the steps are lowered and exposed to provide ample purchase, so that a user is able to climb the ladder as. In an exemplary embodiment, only an adult user is able to toggle from the safety configuration to the ladder configuration, as the toggling control is elevated above a child's reach.

Figure 1:
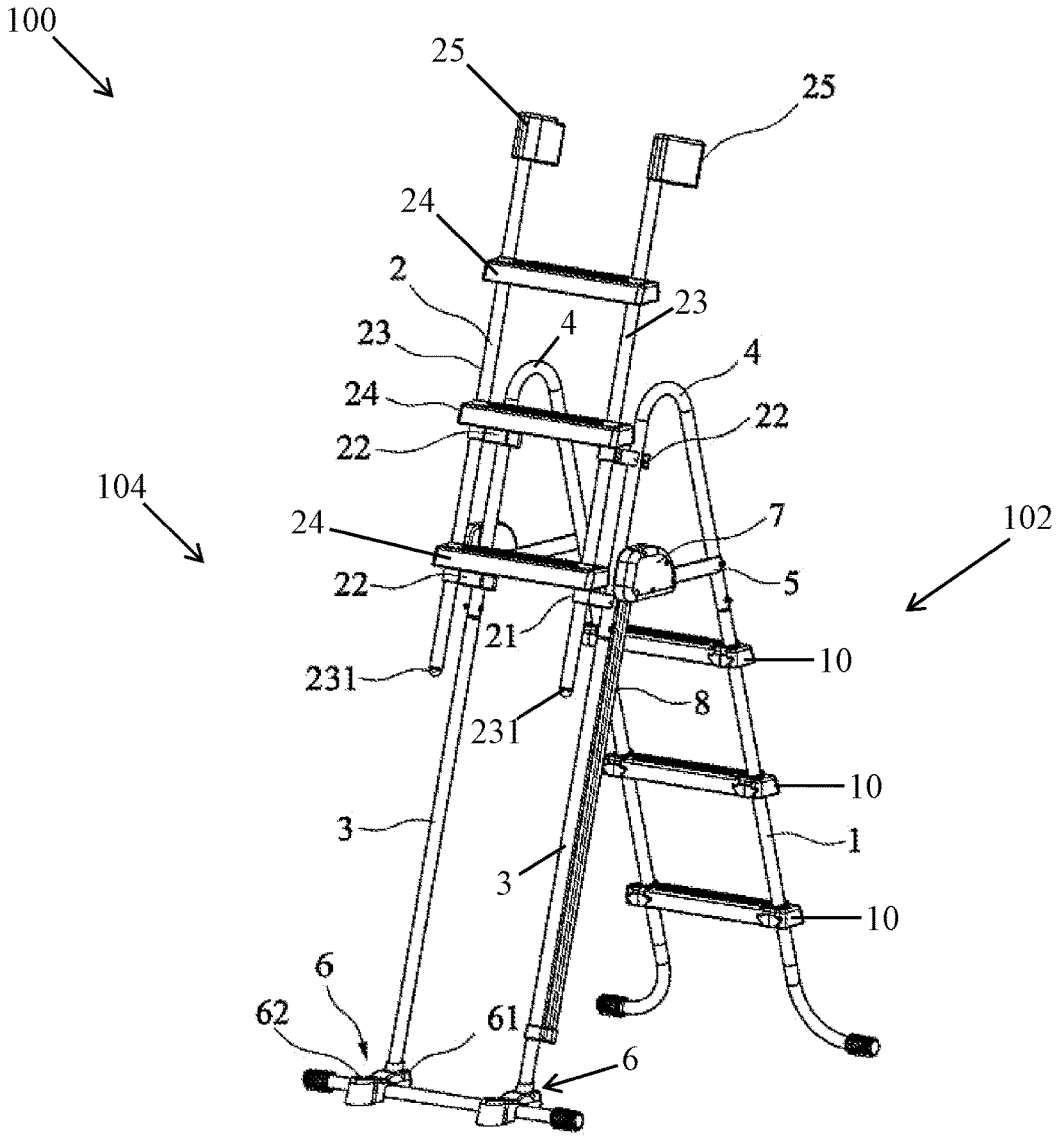
FIG. 1 is a perspective view of a pool ladder made in accordance with the present disclosure, illustrated in a safety configuration such that when used in accordance with a bathing enclosure, the bathing enclosure is inaccessible to a child.

FIG. 1 shows a ladder 100 made in accordance with the present disclosure and configured for use with at least an above-ground bathing enclosure, such as an above-ground pool or spa (not shown). As shown in FIGS. 1, 9, 10, and 11, ladders 100, 100A, 100B each have a fixed portion 102 configured to be positioned along an inner side of a bathing enclosure (not shown) and a moveable portion 104 configured to be positioned along an outer side of bathing enclosure (not shown). In an exemplary embodiment, fixed and moveable portions 102, 104 of ladders 100, 100A, 100B each include a pair of uprights 1, 3, respectively of sufficient length and configuration to provide adequate ladder clearance for placement over an above-ground pool or spa wall between 3 and 5 feet high. In the illustrated embodiment, for example, uprights 1 form a pair of inverted V-shapes with uprights 3, such that the fixed portion can be placed inside the bathing enclosure and the moveable portion can be placed outside the bathing enclosure. Fixed portion 102 has a plurality of ladder steps 10 spanning the lateral gap between uprights 1. For example, in the illustrated embodiments, the pair of uprights may be referred to as a left upright and a right upright taken from the perspective of a user such that a user will grasp left upright with their left hand and right upright with their right hand when entering bathing enclosure.

Fixed portion 102 is constructed similar to a conventional ladder, with steps 10 spanning uprights 1 and providing for egress from the bathing enclosure. Moveable portion 104 includes uprights 3, which form a moveable ladder support structure, and the moveable ladder assembly itself, which is slideably supported along one or both of the uprights as described further below. This allows steps 24 of moveable portion 104 to be only selectively exposed to facilitate ingress to the bathing enclosure only when the moveable portion 104 is configured for ingress by an approved (e.g., adult) user.

Ladders 100, 100A, 100B include handles or railings 4 coupled to respective upper ends of uprights 1, 3 and configured to extend above an upper lip of a bathing enclosure. Also included in ladder 100 is a stabilizing plate 5 spanning the gap between uprights 1 of fixed portion 102 and uprights 3 of moveable portion 104.

The plurality of steps 10 on fixed portion 102 of ladders 100, 100A, 100B are stationary and remain available at all times to users wishing to exit a bathing enclosure. The moveable portion 104 includes a moveable ladder 2 moveable between a safety configuration shown in FIGS. 1, 8 and a ladder configuration shown in FIG. 9. More particularly, when in the ladder configuration most clearly illustrated in FIG. 9, the ladder steps 24 are lowered and generally parallel to the ground so as to be positioned to receive a user's foot and provide ample purchase as the user ascends moveable portion 104. However, when in the safety configuration illustrated in at least FIGS. 1 and 8, the ladder steps 24 of moveable ladder 2 are positioned further up on uprights 3 and elevated away from the ground by a distance sufficient to prevent a typical user from reaching the first ladder step 24 from the ground. Thus, when ladder 100, 100A, 100B is in the safety configuration, a user is not able to gain purchase with his/her foot on any of the steps due to the height at which ladder steps 24 are positioned and therefore cannot use ladder 100, 100A, 100B to enter the bathing enclosure. In an exemplary embodiment, the height of the first ladder step 24 is spaced vertically from the ground between about 3 feet and about 5 feet when ladder 100, 100A, 100B is in the safety configuration. Thus, in such exemplary embodiment, the first ladder step 24 may be at about the same vertical position at the upper edge of the pool or spa wall to which ladder 100, 100A, 100B is applied.

Figure 6:
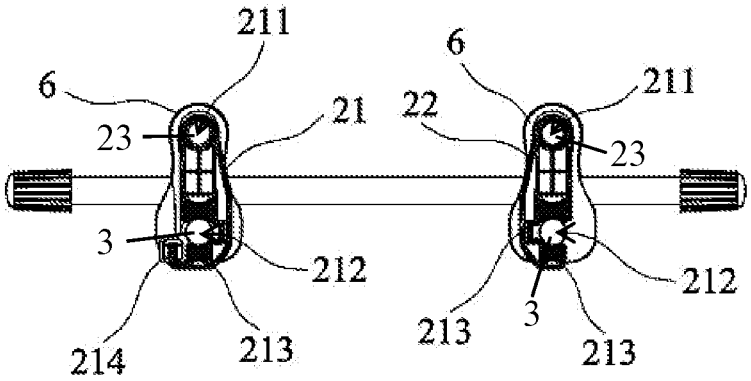
FIG. 6 is a top plan view of a foot stand of the pool ladder shown in FIG. 1.
Figure 9:
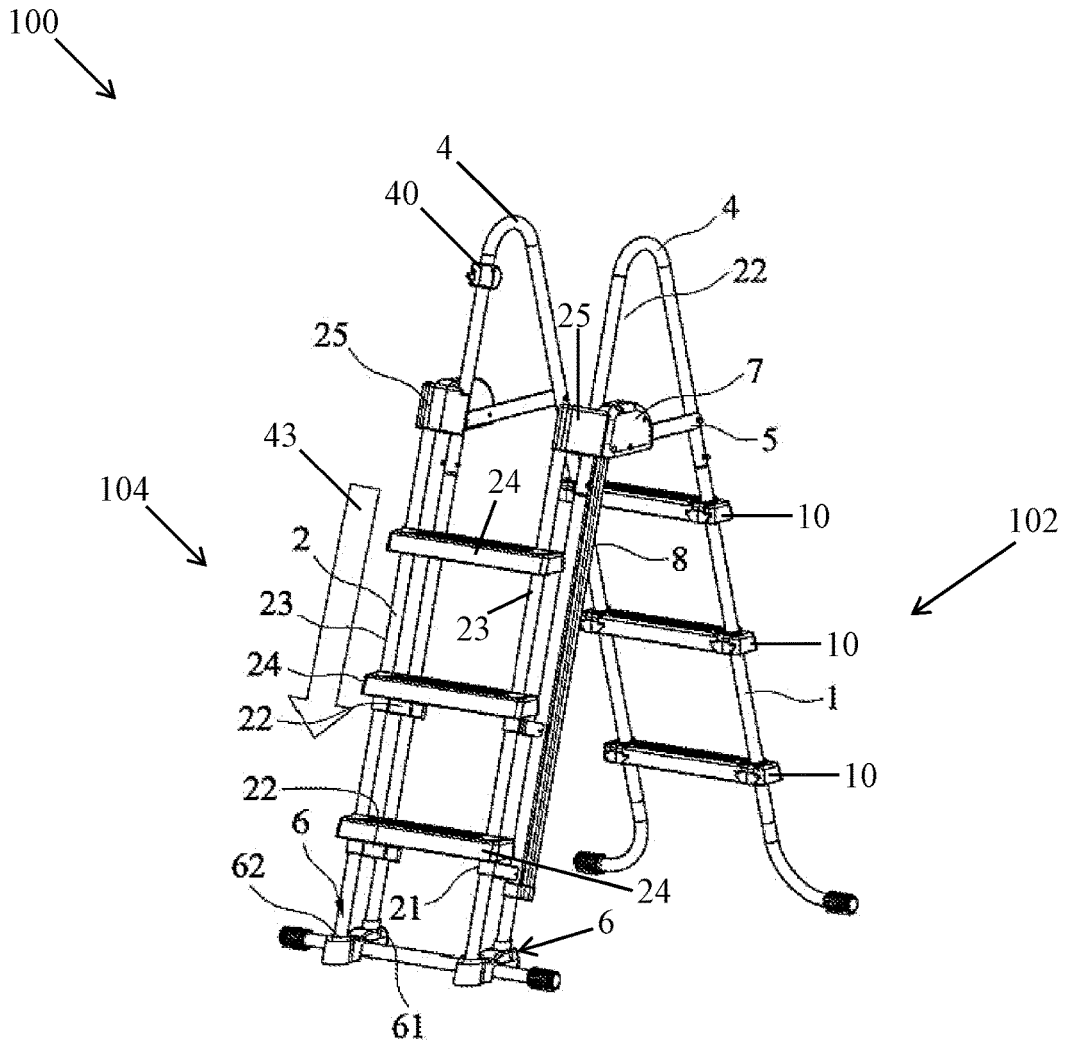
FIG. 9 is a perspective view of the pool ladder of FIG. 1 as the ladder is transitioning to a ladder configuration.

Moveable ladder 2 includes rods 23 and a plurality of ladder steps 24 spanning the gap between rods 23. The bottom of rod 23 is provided with a leg or leg portion 231 sized to establish an appropriate vertical distance between the ground and the first ladder step 24 when moveable ladder 2 is in the lowered, ladder configuration (FIG. 9). Moveable ladder 2 further includes a first connector 21 and a plurality of second connectors 22, where the first connector 21 and the second connector 22 are respectively provided with connecting holes 211 (FIG. 3) which receive a respective rod 23 of moveable ladder 2 as shown in FIG. 6. Connectors 21, 22 are also provided with a groove 212 (FIG. 3) that receives a respective upright 3 (FIG. 6). Opening groove 212 is provided with a set of pulleys 213 disposed on either side of upright 3 when assembled, so that first connector 21 and second connector 22 can slide freely along upright 3 while also being captured upon upright 3 by the hourglass-shape of the outer surfaces of the pulleys 213. The first connector 21 differs from the second connector 22 in that it is also provided with a perforation 214 for connection with traction device 8 (FIG. 1), where first connector 21 is fixed to the lower part of a respective rod 23, the second connector 22 is fixed to the middle part of the respective rod 23 as shown in FIG. 1.

Moveable ladder 2 further includes a pair of third connectors 25 that have one end connected to the top of rods 23. The other end of third connectors 25 can selectively couple to uprights 3 to provide additional stability to moveable ladder 2 in the ladder configuration, while being able to decouple for the safety configuration. That is, the coupling of third connectors 25 and uprights 3 provide additional stability when a user climbs moveable ladder 2.

Figure 2:
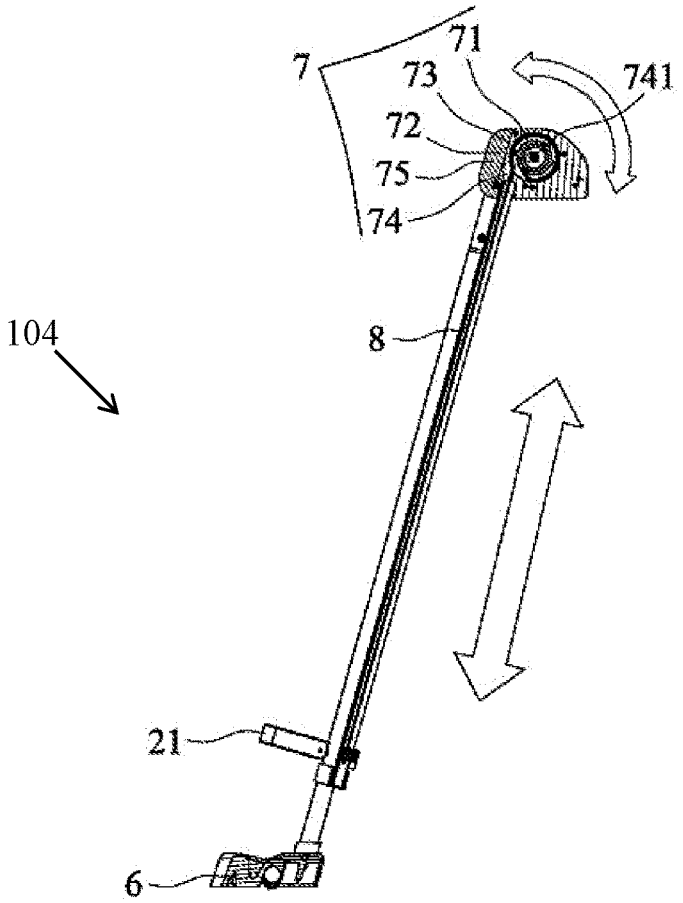
FIG. 2 is a side elevational, partial cross-section view of a moveable portion of the pool ladder of FIG. 1.

Referring now to FIG. 2, moveable portion 104 of ladder 100 includes a reset device 7 located at the connection between at least one of the uprights 3 and the stabilizing plate 5. Reset device 7 provides the mechanism by which moveable ladder 2 transitions between the safety configuration and the ladder configuration. Reset device 7 includes a torsional spring 71, a rotary retractor 72, and a damper 73 contained within an interior space defined by a lower cover 74 and an upper cover 75 (FIG. 7B). Torsional spring 71, rotary retractor 72, and damper 73 are arranged on a stud 741 that is provided within lower cover 74 or within upper cover 75. Rotary retractor 72 is connected to and drivingly engaged with traction device 8. Traction device 8 is functionally connected to both reset device 7 and moveable ladder 2, such as via screw holes provided with upper cover 75 and lower cover 74 such that the entire reset device 7 can be locked on at least one of uprights 3 and stabilizing plate 5 by screws inserted into the screw holes. Traction device 8 cooperates with reset device 7 to assist or perform the lifting of moveable ladder 2, so that the bottom of moveable ladder 2 moves away from the ground when the ladder is not held in place by, e.g., a user as further described herein. Exemplary embodiments of reset device 7 and traction device 8 are shown in FIGS. 7-11A and described in detail below.

Figure 4A:
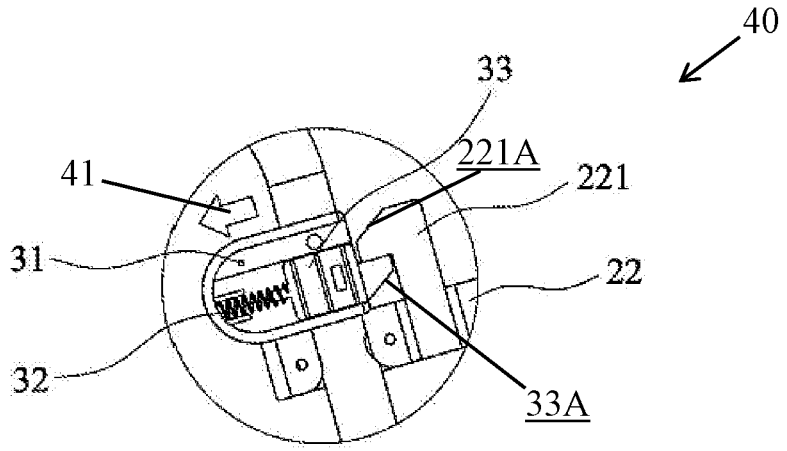
FIG. 4A is a side elevation, partial cross-section view of a self-locking device of the pool ladder of FIG. 1 as the self-locking device begins transitioning from a locked configuration to an unlocked configuration.
Figure 4B:
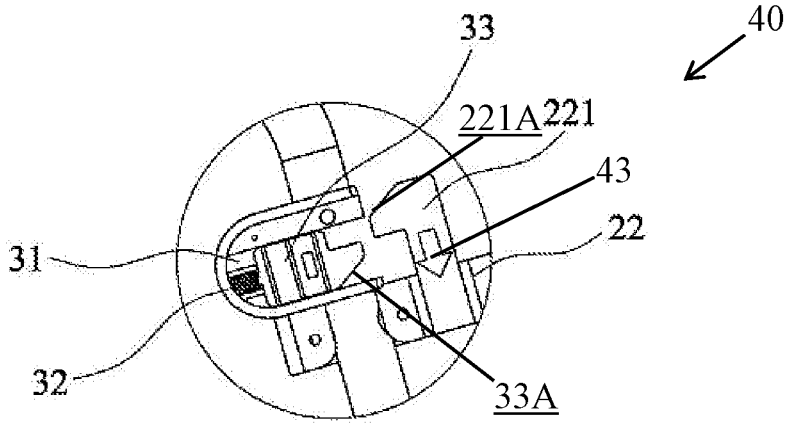
FIG. 4B is a side elevation view of the self-locking device of FIG. 4A with the self-locking device in the unlocked configuration.

As shown in FIGS. 4A and 4B, a self-lock device 40 is provided at the top of one of uprights 3 to automatically lock moveable ladder 2 thereby preventing moveable ladder 2 from falling or otherwise suddenly transitioning from the safety configuration to the ladder configuration. Self-lock device 40 is selectively coupled to a second connector 22 and includes a fixture 31 provided at the top of upright 3, spring 32, buckle 33, and a hook 221 on the second connector 22 is positioned near the middle of the rod 23.

In FIG. 4A, self-lock device 40 is shown in a locked configuration which is associated with the default safety configuration of ladder 100 (as shown in at least FIG. 1). In this configuration, no external force is applied to spring 32 such that buckle 33 is biased outwardly and protrudes out of fixture 31. In this default locked configuration, buckle 33 engages with hook 221 of second connector 22 such that moveable ladder 2 remains in the safety configuration and cannot descend along uprights 3 to transition to the ladder configuration without user intervention. When a user wants to access moveable ladder 2, the self-lock device 40 is moved to an unlocked configuration by compressing spring 32 along the direction of arrow 41. Buckle 33 therefore moves into fixture 31 such that buckle 33 becomes disengaged from hook 221. When so disengaged, buckle 33 is not in the pathway of moveable ladder 2, thereby allowing moveable ladder 2 to descend along uprights 3 as generally indicated by arrow 43 (FIG. 4B) and transition to the ladder configuration.

Hook 221 is provided with a slanted surface 221A, and buckle 33 has a correspondingly slanted surface 33A as shown in FIGS. 4A and 4B. When transitioning from the ladder configuration to the safety configuration, moveable ladder 2 moves along direction 45 (FIG. 8), and slanted surface 221A applies a force onto slanted surface 33A. The applied force compresses spring 32 to provide clearance for hook 221 to move beyond the ledge of buckle 33. Once hook 221 clears the ledge, a force is no longer applied to spring 32, and spring 32 expands causing buckle 33 to engage with hook 221 and maintain moveable ladder 2 in the safety configuration.

Figure 5:
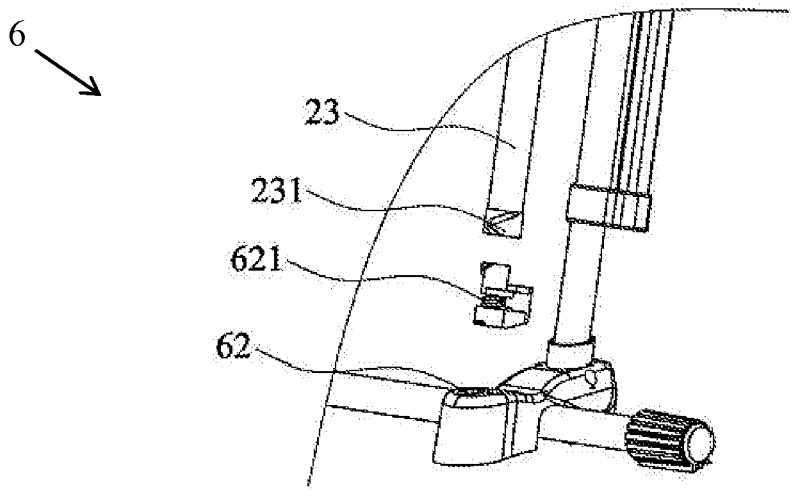
FIG. 5 is a perspective, partially exploded view of a foot stand of the pool ladder of FIG. 1.
Figure 5A:
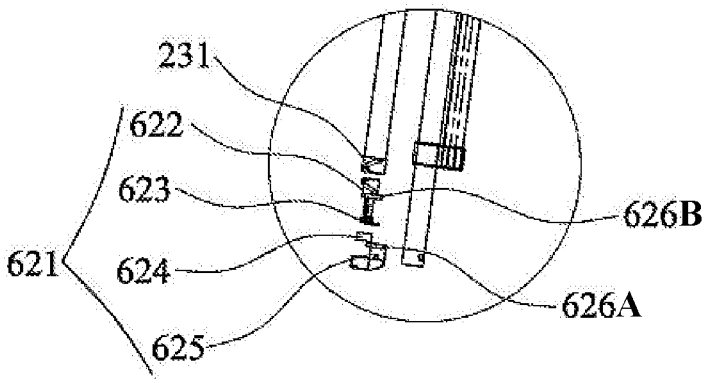
FIG. 5A is a perspective, partially exploded view of a rotatable shaft of the foot stand of FIG. 5.

Moveable portion 104 further includes a foot stand 6 that is provided with an aperture 61, which provides for the insertion of uprights 3, and a locking receiver 62 (FIG. 5) which receives rods 23 and temporarily locks moveable ladder 2 in the ladder configuration, thereby facilitating a safe and predicable transition from the ladder configuration to the safety configuration via a spring and damper mechanism discussed herein. As shown in FIG. 5, locking receiver 62 of foot stand 6 has a rotatable shaft 621. Shaft 621 and the leg 231 of the rod 23 forms a temporary lock mechanism. As shown in FIG. 5A, shaft 621 further includes a shaft lever 622, a torsional spring 623, a damper 624, and a deck 625. Shaft lever 622 and leg 231 are provided with mating threads by which they are operably coupled. Spring 623 and damper 624 are fixed to the lower part of shaft lever 622 when assembled, which is set in the groove of deck 625. The upper part of deck 625 and the middle part of shaft lever 622 are provided with interlocking locking surfaces 626A, 626B, respectively, and the shaft 621 and leg 231 are inserted in the locking receiver 62.

Figure 5B:
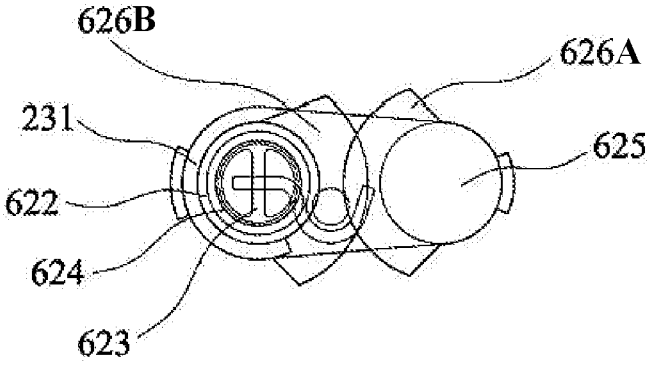
FIG. 5B is a top plan view of the foot stand components shown in FIG. 5, shown in a locked configuration.

When moveable ladder 2 is actuated and pulled down and a user steps onto ladder steps 24, leg 231 presses down on rotatable shaft 612. This downward force causes the mating threads to engage, which urges rotation of rotatable shaft 621. This rotation compresses spring 623 into a storage state, as locking surface 626B of shaft lever 622 rotates and engages with locking surface 626A of the deck 625, as shown in FIG. 5B. When locking surfaces 626A, 626B are so engaged, moveable portion 104 is locked in its lowered, ladder configuration.

Figure 5C:
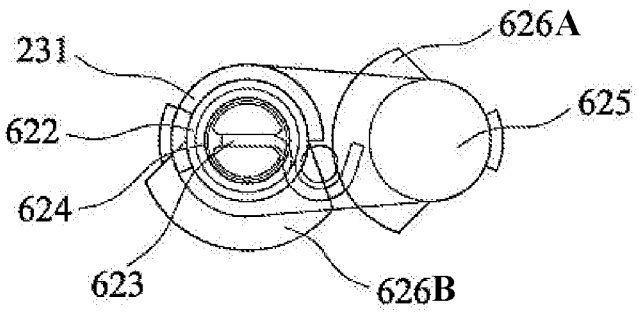
FIG. 5C is a top plan view of the foot stand components of FIG. 5, shown in an unlocked configuration.

When a person releases moveable ladder 2 (e.g., by stepping off of steps 24), the force urging spring 623 is into its compressed state is removed. In turn, due to the dampening effects of damper 624, spring 623 is slowly released, which thereby slowly rotates shaft lever 622 away from its locked configuration into an unlocked configuration in which locking surface 626B of shaft lever 622 rotates out of engagement with lock surface 626A of deck 625, as shown in FIG. 5C. The temporary lock mechanism is thereby released, which allows moveable ladder 2 to return to its default, safety configuration under the biasing force of reset device 7 (described above). In other words, damper 624 acts against the bias of spring 623 and limits the speed with which the biasing force of spring 623 translates moveable ladder 2 upwardly. In an exemplary embodiment, the counteracting force of damper 624 is calibrated to permit moveable ladder 2 to return to its safety configuration only after a predetermined length of time. This time delay prevents accidents that can result from abruptly returning moveable ladder 2 to its safety configuration (FIGS. 1, 8) immediately upon release of rod 23 by the user. This gives the user time to safely ascend or descend moveable ladder 2 via ladder steps 24 of safety blocks 12 before moveable ladder 2 returns to its safety configuration.

Figure 3:
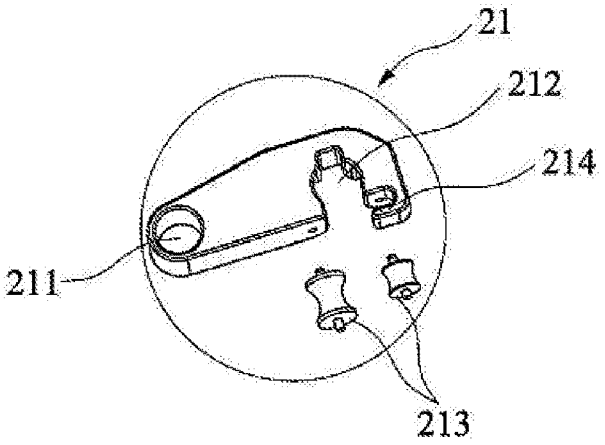
FIG. 3 is a perspective view of a connector and the corresponding components of the connector shown in FIGS. 1 and 2 in accordance with the present disclosure.
Figure 7:
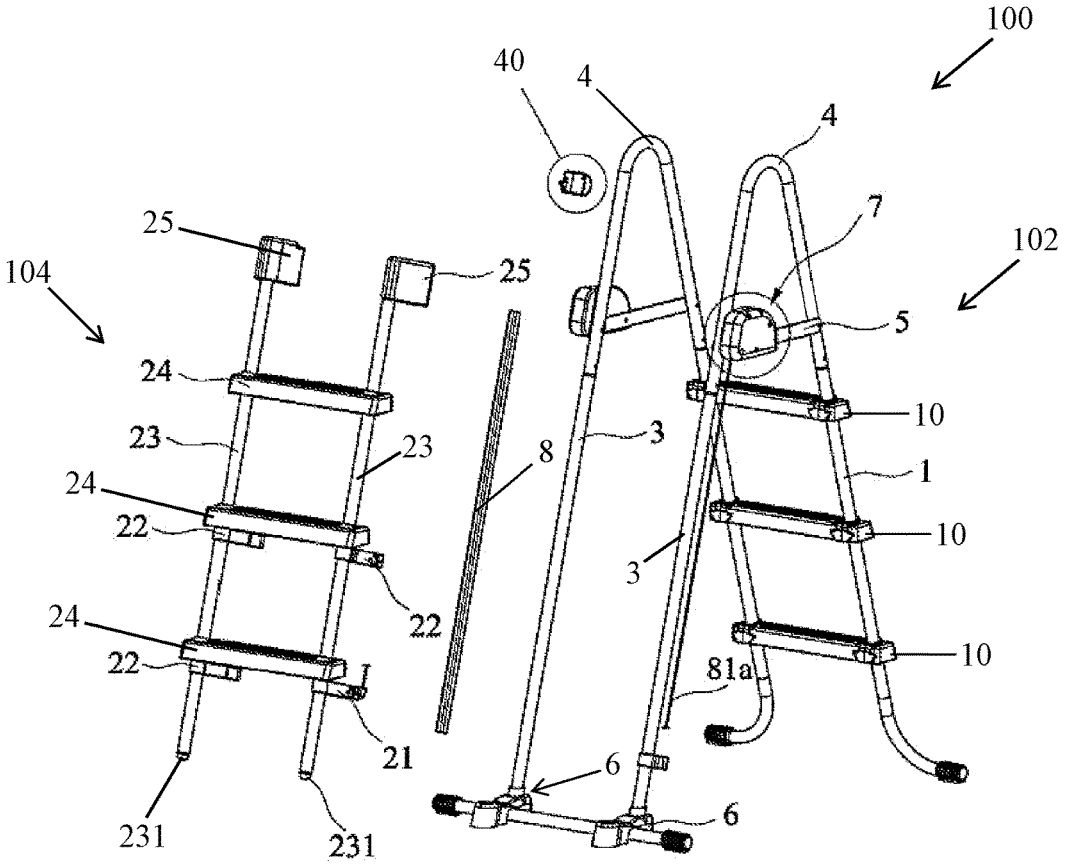
FIG. 7 is an exploded, perspective view of an embodiment of the pool ladder of FIG. 1.
Figure 7A:
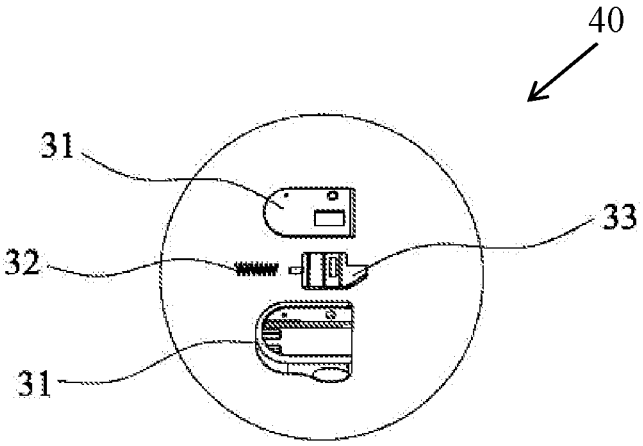
FIG. 7A is an exploded view of a self-lock device of the pool ladder of FIG. 7.
Figure 7B:
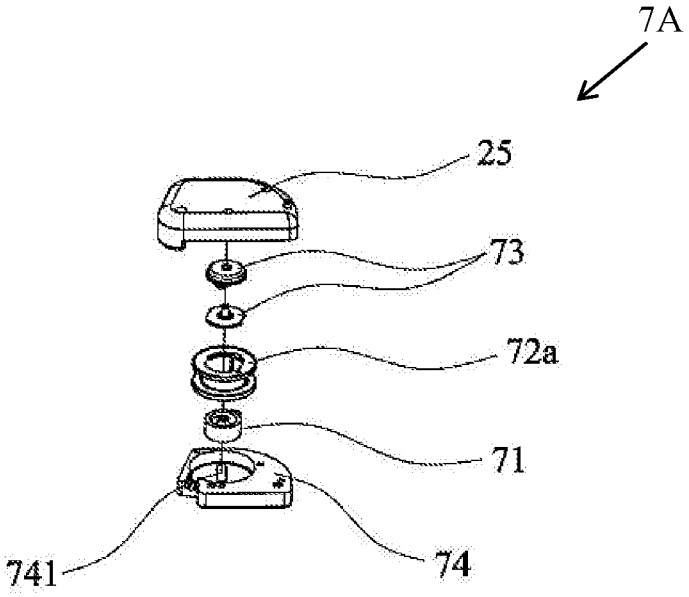
FIG. 7B is an exploded view of a reset device of the pool ladder of FIG. 7.

In one embodiment, as shown in FIGS. 7, 7A, 7B, traction device 8 includes a tension wire 81*a* (FIG. 7), while reset device 7A uses a reel 72*a* (FIG. 7B) to perform the function of rotary retractor 72. In this embodiment, one end of tension wire 81*a* is fixed to reel 72*a* of reset device 7A, with the other end fixed to perforation 214 of connector 21 (FIG. 3). Damper 73 is also operably coupled with reel 72*a* in order to ensure a moderation in the pace of release of spring 71 and the associated retraction of moveable ladder 2. In an exemplary embodiment, a protective sleeve can be provided over the tension wire 81*a* to insulate users from the potential for contact with the movement of the wire during extension or retraction of moveable ladder 2.

Figure 8:
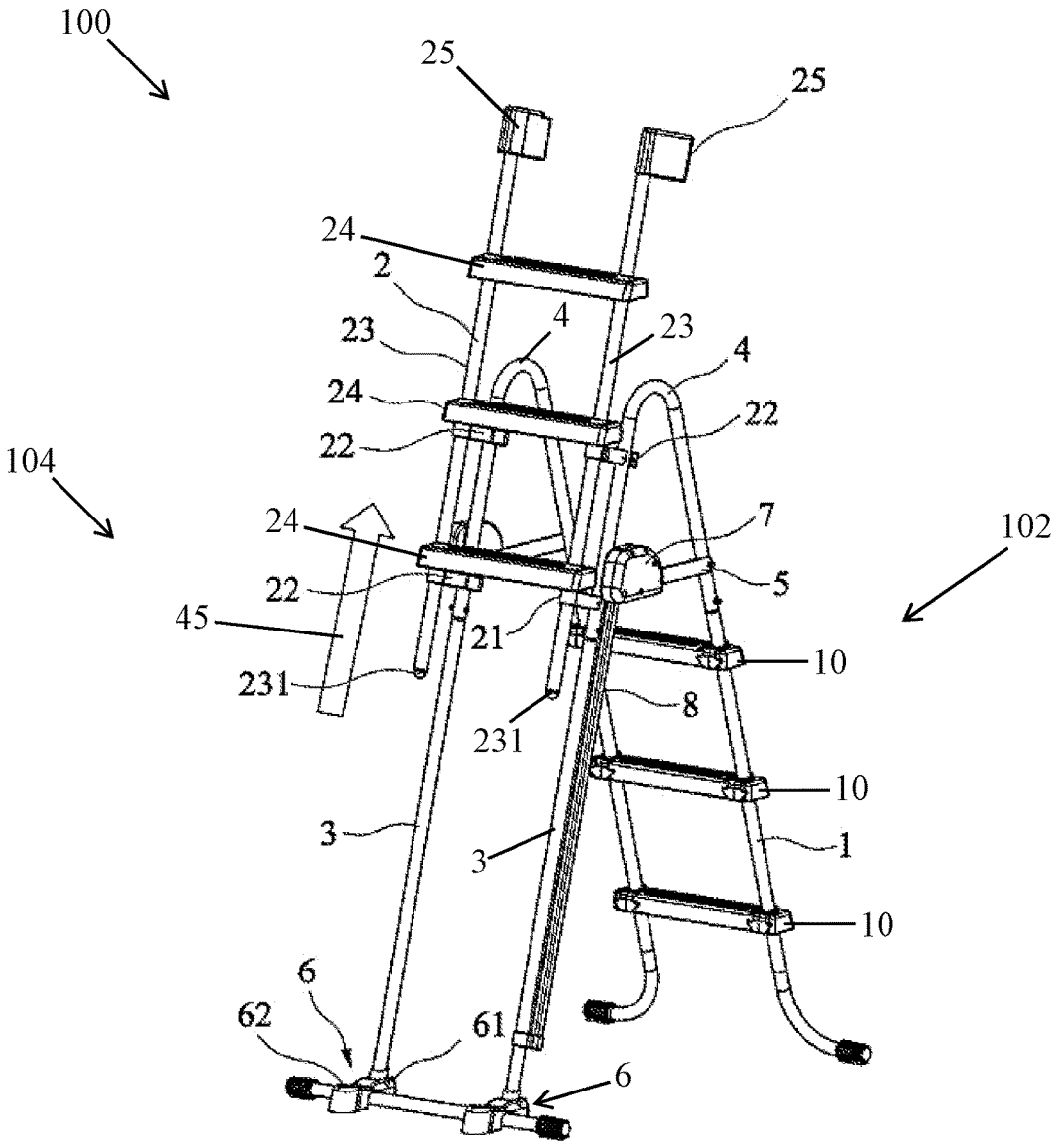
FIG. 8 is a perspective view of the pool ladder of FIG. 1 as the ladder is transitioning to the safety configuration.

FIG. 8 shows ladder 100 in its default, safety configuration where moveable ladder 2 is raised from the ground due to the functioning of reset device 7 discussed herein to prevent a child from accessing ladder steps 24. That is, the bottom leg 231 and the lowest ladder steps are positioned higher than the reach of a child's arm to prevent a child from climbing moveable ladder 2 and/or accessing the interior of a pool or spa on the side of fixed portion 102 without adult supervision.

FIG. 9 shows ladder 100 in its ladder configuration where a user can access ladder steps 24 of moveable ladder 2. To transition ladder 100 from the safety configuration of FIG. 8 to the ladder configuration of FIG. 9, a person needs to have a certain height to access and release self-lock device 40 by pulling buckle 33 along direction 41 (FIG. 4A) to compress spring 32, and then pull down moveable ladder 2 along direction 43 (FIGS. 4B, 9). Once moveable ladder 2 has descended along uprights 3, a person climbs moveable ladder 2 using ladder steps 24. By applying pressure onto moveable ladder 2 (via a person's bodyweight), rod 23 and bottom leg 231 are rotated by the screw drive of rotating shaft 621, as described above, such that the temporary lock mechanism of shaft 621 and leg 231 of rod 23 is locked and the torsion springs 623, 71 in the rotating shaft 621 and reset device 7, respectively are both compressed storing potential energy.

When pressure is no longer applied onto moveable ladder 2, torsion spring 623 allows the temporary lock mechanism to release, as described herein, and torsion spring 71 then allows reset device 7 to retract the moveable ladder 2 under the force of the previously stored potential energy. In turn, rotating shaft 621 slowly rotates, unlocking the temporary fixing lock slowly. Then, reel 72*a* rotates slowly and drives the tension wire 81*a* to retract and lift moveable ladder 2 through first connector 21 until second connector 22 is fixed in the middle of rod 23 and against buckle 33 of fixture 31 (FIG. 4A) along direction 45 (FIG. 8). When moveable ladder 2 is fully retracted to the safety configuration, hook 221 and buckle 33 become coupled to each other as also described above, locking self-lock device 40 and maintaining moveable ladder 2 in its safety configuration.

Figure 10:
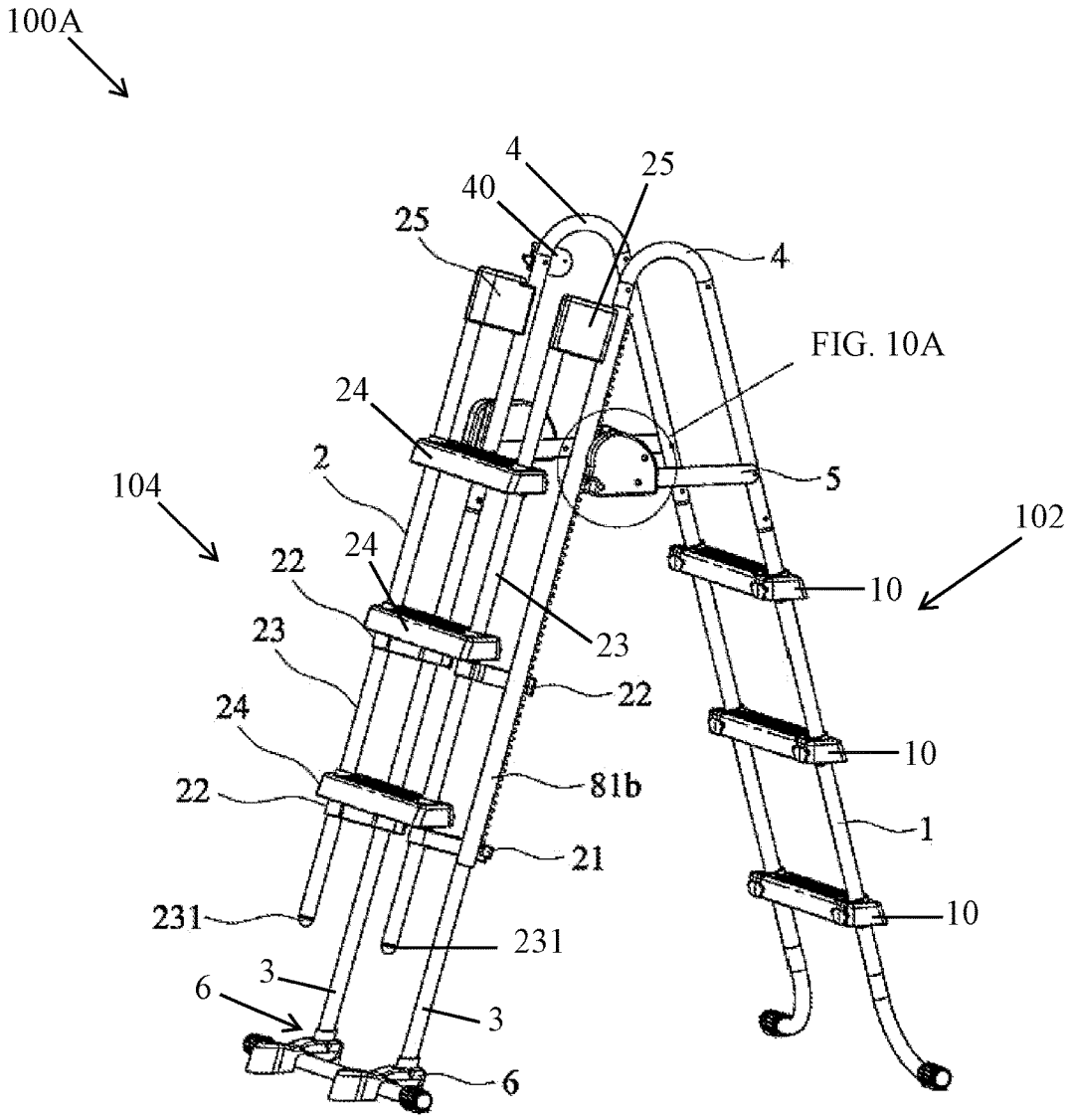
FIG. 10 is a perspective view of an embodiment of the pool ladder of FIG. 1 having an alternate reset device in accordance with the present disclosure.
Figure 10A:
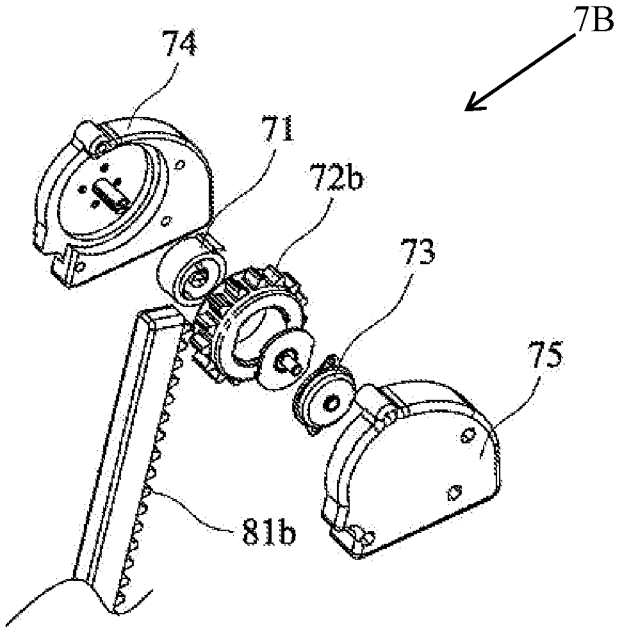
FIG. 10A is an exploded, perspective view of the alternate reset device used in the pool ladder of FIG. 10.

Referring to FIGS. 10 and 10A, an alternate embodiment of ladder 100 is shown and referred to as ladder 100A. Ladder 100A includes the same features of ladder 100, and corresponding reference numbers indicate corresponding structure and function. However, ladder 100A excludes reel 72*a*, of reset device 7A, instead utilizing reset device 7B including gear 72*b* (FIG. 10B). Correspondingly, traction device 8 utilizes rack 81*b* spanning the distance between first connector 21 and second connector 22 along rod 23, and progressing further upwardly along the outer surface of rod 23. The length of the rack 81*b* is shorter than the length of upright 3. Gear 72*b* and rack 81*b* are drivingly coupled to each other and meshingly engaged in a manner similar to that of a rack and pinion system where both gear 72*b* and rack 81*b* each have protrusions and grooves that correspond with one another. Torsion spring 71 acts to rotate gear 72*b* to retract moveable ladder 2 toward the safety configuration by interaction with rack 81*b*, while damper 73 controls the speed of such retraction.

Figure 11:
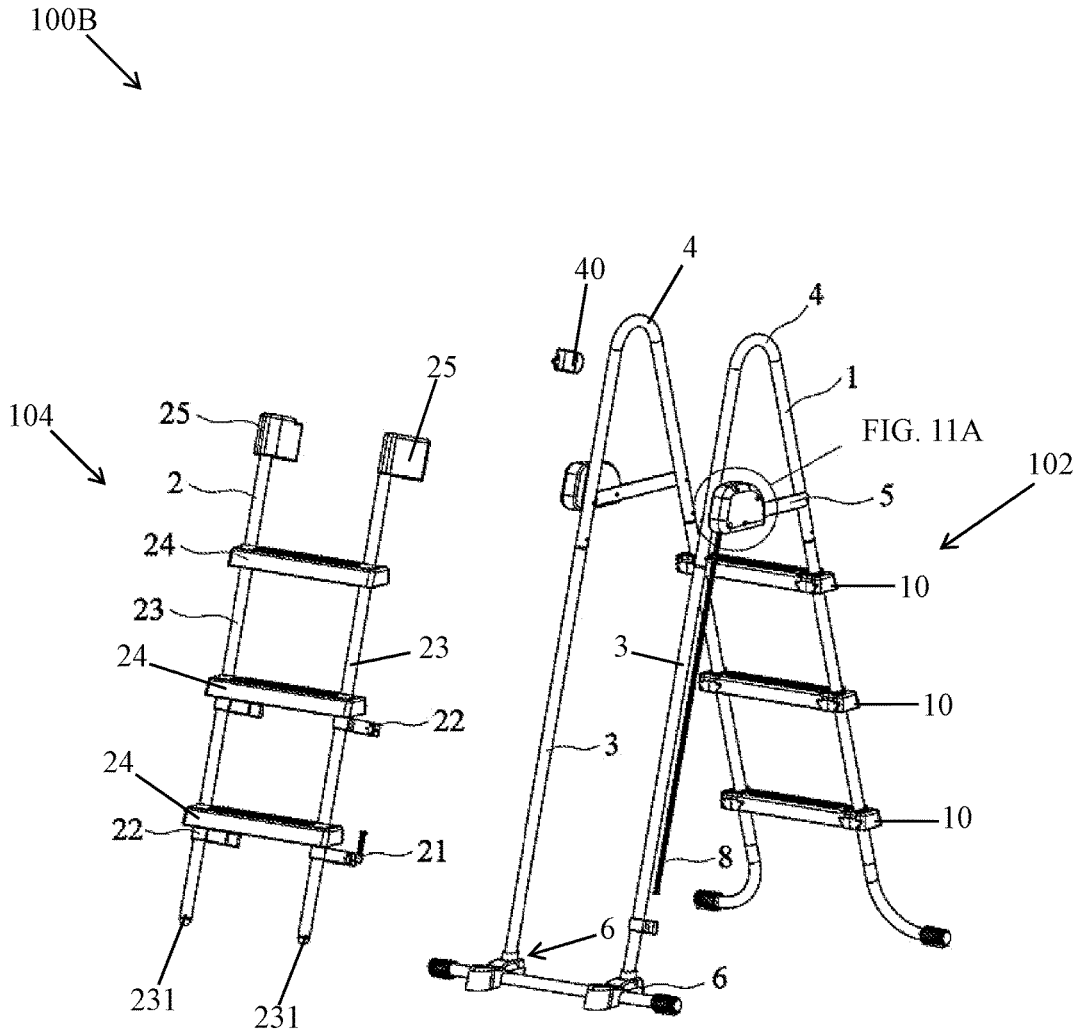
FIG. 11 is a perspective view of an embodiment of the pool ladder of FIG. 1 having an alternate reset device in accordance with the present disclosure.
Figure 11A:
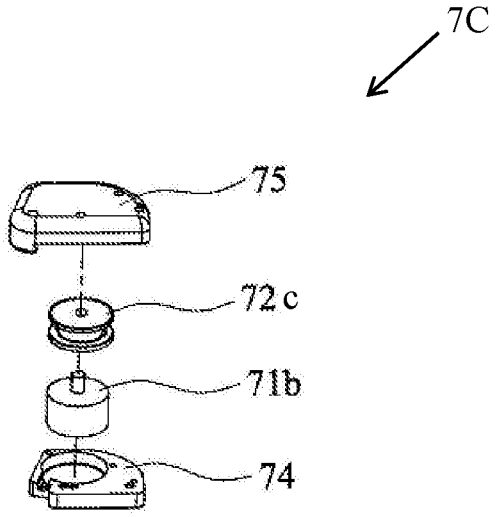
FIG. 11A is an exploded view of the alternate reset device of FIG. 11.

As shown in FIGS. 11 and 11A, another alternate embodiment of ladder 100 is shown and generally indicated as 100B. Ladder 100B is similar to ladders 100 and 100A described above, and corresponding reference numbers indicate corresponding structure and function. However, ladder 100B has another alternative reset device 7C including a motor 71*b* in place of torsion spring 71 described above, and a spool 72*c* rotatably fixed to the mandrel of motor 71*b*, These components are contained by an upper cover 75 and a lower cover 74, similar to previously-discussed embodiment. Motor 71*b* is rotatably fixed via a key/groove arrangement to upper cover 75 and/or lower cover 74. Further, reset device 7C also includes an induction controller which controls motor 71B and thereby drives spool 72*c*, which in turn, drives traction device 8 and moves the moveable ladder 2 between the safety configuration and the ladder configuration.

In use, when an adult unlocks the self-lock device, the induction controller senses a signal (e.g., received from a button or sensor mounted to self-lock device 40) and controls the motor 71*b* to move moveable ladder 2 to the ladder configuration thereby facilitating the use of ladder 100B. When the induction controller no longer senses the adult's signal, the induction controller controls motor 71*b* to move moveable ladder 2 back to its safety configuration where moveable ladder 2 is automatically locked with self-lock device 40 to prevent a child from accessing ladder 100B without adult supervision.

The components of reset devices 7A, 7B and 7C can be combined with one another in any desired combination. For example spool 72*c* can be excluded from motorized reset device 7C and replaced with gear 72*b* (FIG. 10A) such that the rack-and-pinion arrangement of reset device 7B is motor-driven. For purposes of the present disclosure, any reference to reset device 7 includes any of reset devices 7A, 7B or 7C or any combination of features thereof.

While this invention has been described as having exemplary designs, the present disclosure can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A ladder assembly comprising:

a fixed portion including a first left upright, a first right upright cooperating with the first left upright to define a first lateral gap, and at least one fixed ladder step spanning the first lateral gap;

a moveable ladder support including a second left upright and a second right upright respectively cooperating with the first left upright and the first right upright to form a space sized to receive a wall of a bathing enclosure between the moveable ladder support and the fixed portion;

a moveable ladder slidably coupled to at least one of the second left upright and the second right upright, the moveable ladder including a left support rod and a right support rod defining a second lateral gap and at least one moveable ladder step spanning the second lateral gap;

the moveable ladder moveable along at least one of the second left upright and the second right upright between a safety configuration, in which the at least one moveable ladder step is positioned in at a first elevation, and a ladder configuration, in which the at least one moveable ladder step is positioned in at a second elevation lower than the first elevation; and a lock device including a buckle and a biasing element urging the buckle into a locking configuration in which the buckle engages the moveable ladder in the safety configuration, the buckle moveable against the urging of the biasing element into a disengaged configuration in which the buckle disengages from the moveable ladder such that the moveable ladder is free to move from the safety configuration to the ladder configuration;

a foot stand coupled to a lower end of at least one of the second left upright and the second right upright, wherein the foot stand comprises:

an aperture sized to receive one of the second left upright and the second right upright; and a locking receiver sized to receive one of the left and right support rods of the moveable ladder, the locking receiver configured to selectively lock the respective support rod into place to selectively prevent movement of the moveable ladder from the ladder configuration toward the safety configuration.

2. The ladder assembly of claim 1, wherein:

a rotatable shaft is operably coupled to the left support rod or the right support rod received in the locking receiver, the rotatable shaft comprising a shaft lever including a locking surface and a spring, and a deck including a locking surface and a damper, wherein the deck is selectively operably coupled to the shaft lever via the respective locking surfaces; and the rotatable shaft is moveable between a closed configuration, in which the locking surface of the shaft lever locks with the locking surface of the deck such that the moveable ladder is held in the ladder configuration, and an open configuration, in which the locking surface of the shaft lever is disengaged from the locking surface of the deck such that the moveable ladder can transition to the safety configuration.

3. The ladder assembly of claim 1, further comprising a reset device coupled to at least one of the fixed portion and the moveable ladder support, the reset device configured to move the moveable ladder from the ladder configuration to the safety configuration, the reset device comprising:

a spring;

a damper operably coupled with the spring such that the damper acts to limit a rate of spring extension to thereby automatically delay return of the moveable ladder from the ladder configuration to the safety configuration; and a rotary retractor acted upon by the spring and the damper, the rotary retractor functionally coupled to the moveable ladder and configured to move the moveable ladder from the ladder configuration toward the safety configuration assisted by a biasing force of the spring.

4. The ladder assembly of claim 3, further including a traction device operably coupled to the rotary retractor of the reset device and fixed to at least one of the second left upright and the second right upright of the moveable ladder support, such that the traction device transfers the force of the spring to the moveable ladder.

5. The ladder assembly of claim 4, wherein:

the traction device comprises a tension wire fixed to at least one of the second left upright and the second right upright of the moveable ladder support; and the rotary retractor comprises a spool sized to receive the tension wire.

6. The ladder assembly of claim 4, wherein:

the traction device comprises a rack fixed to at least one of the fixed portion and the moveable ladder support; and the rotary retractor comprises a gear configured to meshingly engage with the rack.

7. The ladder assembly of claim 4, wherein the moveable ladder further includes a first connector and a second connector coupled to one of the left support rod and the right support rod, wherein the first connector and the second connector slidably couple one of the left support rod and the right support rod of the moveable ladder to a respective one of the second left upright and the second right upright of the moveable ladder support;

the first connector including a hole configured to receive one of the left support rod and the right support rod of the moveable ladder, a groove configured to receive one of the second left upright and the second right upright of the moveable ladder support; and a perforation configured to receive the traction device;

the second connector including a hole configured to receive one of the left support rod and the right support rod of the moveable ladder and a groove configured to receive one of the second left upright and the second right upright of the moveable ladder support.

8. The ladder assembly of claim 7, wherein:

a rotatable shaft is operably coupled to the left support rod or the right support rod received in the locking receiver, the rotatable shaft comprising a shaft lever including a locking surface and a spring, and a deck including a locking surface and a damper, wherein the deck is selectively operably coupled to the shaft lever via the respective locking surfaces; and the rotatable shaft is moveable between a closed configuration, in which the locking surface of the shaft lever locks with the locking surface of the deck such that the moveable ladder is held in the ladder configuration, and an open configuration, in which the locking surface of the shaft lever is disengaged from the locking surface of the deck such that the moveable ladder can transition to the safety configuration.

9. A ladder assembly comprising:

a fixed portion including a first left upright, a first right upright cooperating with the first left upright to define a first lateral gap, and at least one fixed ladder step spanning the first lateral gap;

a moveable ladder support including a second left upright and a second right upright respectively cooperating with the first left upright and the first right upright to form a space sized to receive a wall of a bathing enclosure between the moveable ladder support and the fixed portion;

a moveable ladder slidably coupled to at least one of the second left upright and the second right upright, the moveable ladder including a left support rod and a right support rod defining a second lateral gap and at least one moveable ladder step spanning the second lateral gap, the moveable ladder further comprising:

a first connector and a second connector coupled to one of the left support rod and the right support rod, wherein the first connector and the second connector slidably couple a respective support rod of the moveable ladder to at least one of the second left upright and the second right upright of the moveable ladder support;

the first connector including a hole configured to receive one of the left support rod and the right support rod of the moveable ladder, a groove configured to receive one of the second left upright and the second right upright of the moveable ladder support, and a perforation configured to receive the traction device; and the second connector including a hole configured to receive one of the left support rod and the right support rod of the moveable ladder and a groove configured to receive one of the second left upright and the second right upright of the moveable ladder support;

the moveable ladder moveable along at least one of the second left upright and the second right upright between a safety configuration, in which the at least one moveable ladder step is positioned in at a first elevation, and ladder configuration, in which the at least one moveable ladder step is positioned in at a second elevation lower than the first elevation;

a reset device coupled to at least one of fixed portion and the moveable ladder support, the reset device configured to move the moveable ladder from the ladder configuration to the safety configuration, the reset device further comprising:

a spring;

a damper coupled with the spring such that the damper acts to limit a rate of spring activation to thereby automatically delay return of the moveable ladder from the ladder configuration to the safety configuration; and a rotary retractor acted upon by the spring and the damper, the rotary retractor functionally coupled to the moveable ladder and configured to move the moveable ladder between the ladder configuration and the safety configuration; and a traction device operably coupled to the rotary retractor of the reset device and fixed to at least one of the second left upright and the second right upright of the moveable ladder support, such that the traction device transfers the force of the spring to the moveable ladder;

a hook coupled to the second connector;

a lock device coupled to one of the second left upright and the second right upright, the lock device including a buckle and a biasing element urging the buckle into a locking configuration in which the buckle engages the hook when the moveable ladder is in the safety configuration, the buckle moveable against the urging of the biasing element into a disengaged configuration in which the buckle disengages from the hook such that the moveable ladder is free to move from the safety configuration to the ladder configuration.

10. The ladder assembly of claim 9, further comprising at least one foot stand coupled to at least one of the second left upright and the second right upright, wherein the foot stand includes:

an aperture sized to receive one of the second left upright and the second right upright; and a locking receiver sized to receive one of the left and right support rods of the moveable ladder, the locking receiver configured to selectively lock the respective support rod into place to selectively prevent movement of the moveable ladder from the ladder configuration toward the safety configuration.

11. The ladder assembly of claim 10, wherein:

a rotatable shaft is operably coupled to the left support rod or the right support rod received in the locking receiver, the rotatable shaft comprising a shaft lever including a locking surface and a spring, and a deck including a locking surface and a damper, wherein the deck is selectively operably coupled to the shaft lever via the respective locking surfaces; and the rotatable shaft is moveable between a closed configuration, in which the locking surface of the shaft lever locks with the locking surface of the deck such that the moveable ladder is held in the ladder configuration, and an open configuration, in which the locking surface of the shaft lever is disengaged from the locking surface of the deck such that the moveable ladder can transition to the safety configuration.

12. The ladder assembly of claim 9, wherein the moveable ladder further includes a third connector coupled to one of the left support rod and the right support rod of the moveable ladder, the third connector configured to selectively couple the moveable ladder to the corresponding second left upright or the second right upright of the moveable ladder support when the moveable ladder is in the ladder configuration.

13. The ladder assembly of claim 9, wherein the traction device is a tension wire and the rotary retractor is a reel operably coupled to the tension wire.

14. The ladder assembly of claim 9, wherein the traction device is a rack and the rotary retractor is a gear coupled to the rack.

15. The ladder assembly of claim 9, wherein the reset device includes a motor operably coupled to the traction device and is controlled by an induction controller to move the moveable ladder.

* * * * *